US006001002A

United States Patent [19]

Lea

[11] Patent Number: 6,001,002

[45] Date of Patent: Dec. 14, 1999

[54] HAND-HELD DRILL BIT SHARPENING TOOL

[76] Inventor: Gilbert M. Lea, 4108 14th St., Des Moines, Iowa 50313

[21] Appl. No.: 09/042,877

[22] Filed: Mar. 18, 1998

[51] Int. Cl.[6] ..... B24B 7/00

[52] U.S. Cl. ..... 451/48; 451/375

[58] Field of Search ..... 451/375, 48, 378, 451/386, 391

[56] References Cited

U.S. PATENT DOCUMENTS

| | | | |
|---|---|---|---|
| 2,211,393 | 8/1940 | Travis | 451/375 |
| 2,758,430 | 8/1956 | Sprenzel | 451/375 |
| 2,821,820 | 2/1958 | Thumann | 451/375 |
| 3,393,476 | 7/1968 | York | 451/375 |
| 5,241,791 | 9/1993 | Lacy | 451/375 X |

*Primary Examiner*—David A. Scherbel
*Assistant Examiner*—Anthony Ojini
*Attorney, Agent, or Firm*—Zarley, McKee, Thomte, Voorhees & Sease

[57] ABSTRACT

A hand-held drill bit sharpening tool includes a hand grip portion adapted to be held in a user's hand and a clamp on the grip portion adapted to hold a drill bit for sharpening the tip on a grinding wheel. The bit is held in the clamp by thumb pressure of the user. A sight on the grip portion allows visual alignment of the tip of the bit for proper sharpening of the cutting edges. The sight is adjustable to accommodate different drill bits. A guard is provided on the tool for protecting the user's hand from the grinding wheel.

19 Claims, 6 Drawing Sheets

HAND-HELD DRILL BIT SHARPENING TOOL

BACKGROUND OF THE INVENTION

The cutting edges of drill bits normally become dull through use. Therefore, the cutting edges must be sharpened or the bit must be replaced. Proper sharpening of the cutting edges is important so that the bit will drill efficiently.

Numerous prior art machines exist for sharpening drill bits. Typically, the machine includes a rotatable grinding wheel, with a housing with a hole through which the bit is inserted for engagement with the grinding wheel, so as to sharpen the tip of the bit. Such machines are expensive and do not accurately sharpen the cutting edge of the drill bit. Also, such machines are relatively large in size. Hand-held tools for properly sharpening drill bits are unknown to applicant.

Accordingly, a primary objective of the present invention is the provision of a hand-held tool for facilitating accurate sharpening of the cutting edges on the tip of a drill bit.

Another objective of the present invention is the provision of a tool for holding drill bits of various sizes to facilitate sharpening of the drill bits.

A further objective of the present invention is the provision of a hand-held drill bit sharpening device which permits visual alignment of the drill bit for accurate sharpening of the bit.

Another objective of the present invention is an improved method of sharpening the cutting edge of a drill bit tip using a hand-held tool and visual alignment of the bit with a grinding wheel.

These and other objectives will become apparent from the following description of the invention.

SUMMARY OF THE INVENTION

The tool of the present invention is adapted to hold various sized drill bits for sharpening on a grinding wheel. The tool includes a hand grip for holding in a user's hand or hands and a clamp on the hand grip for holding a drill bit with the tip of the bit extending slightly beyond the clamp. The clamp includes a pair of hinged leaves between which the bit is received and held with thumb pressure from the user. A sight is provided on the hand grip to visually align and orient the bit for sharpening on the grinding wheel. The sight is adjustable both longitudinally and laterally to accommodate drill bits of different sizes and having different cutting tip angles. A guard is also provided on the hand grip to protect the user's hand from the grinding wheel.

In the method of sharpening the cutting edge of a drill bit tip using the hand-held tool of the present invention, the bit is placed in the clamp and held with the pressure of the user's thumb or thumbs. The user visually aligns the drill bit tip through the tool sight, the bit tip and the axis of the grinding wheel. The cutting edge of the drill bit is maintained in a horizontal orientation during sharpening as the user looks in a direction perpendicular to the grinding surface of the grinding wheel.

DETAILED DESCRIPTION OF THE DRAWINGS

Figure 1:
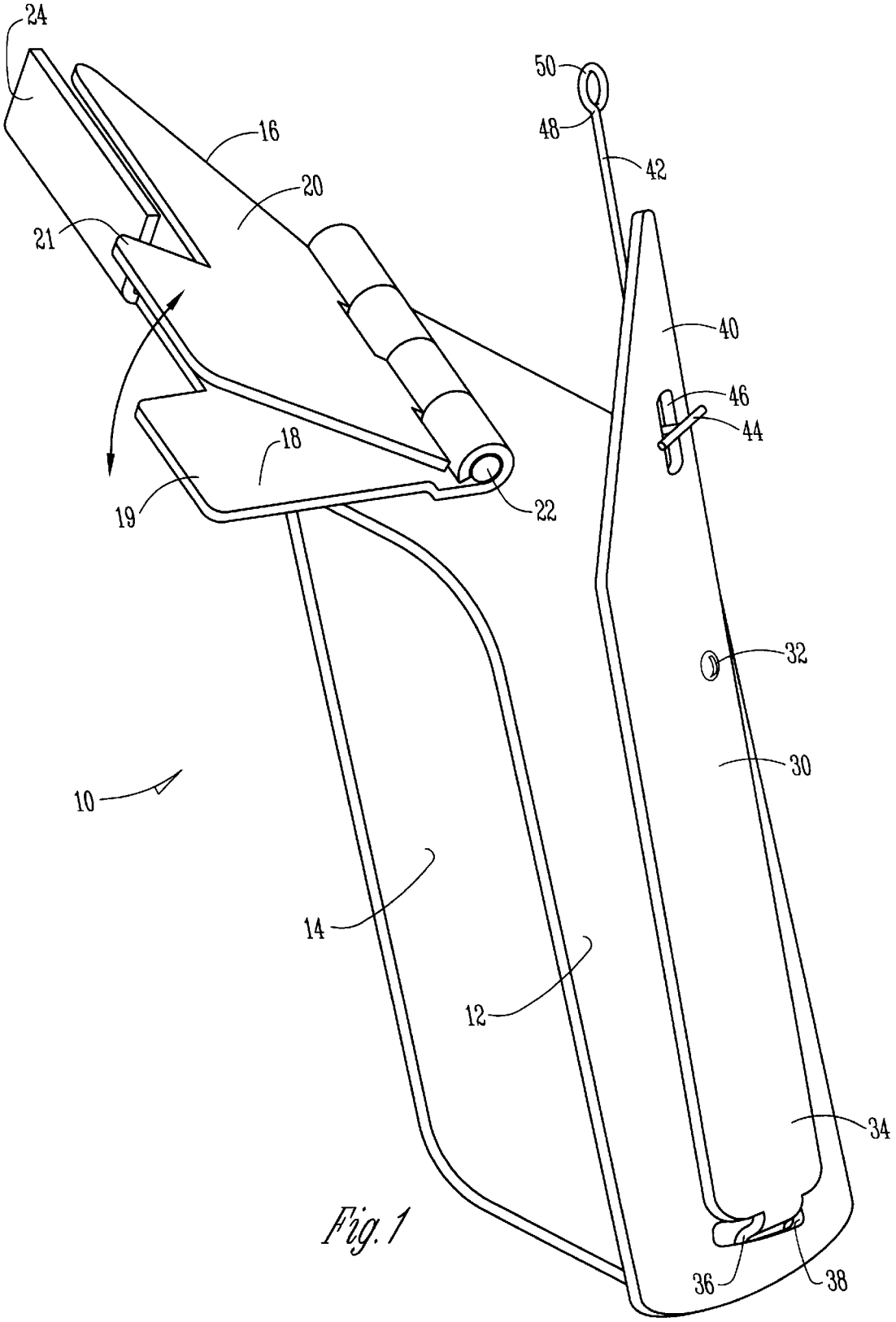
FIG. 1 is a perspective view of the drill bit sharpening tool of the present invention.

The hand-held drill bit sharpening tool of the present invention is generally designated in the drawings by the reference numeral 10. The tool includes a hand grip portion 12 and a protective guard 14. The hand grip 12 and the guard 14 may be made of any suitable material, such as metal or plastic and may be coated with a material to provide a comfortable grip for a user.

Figure 3:
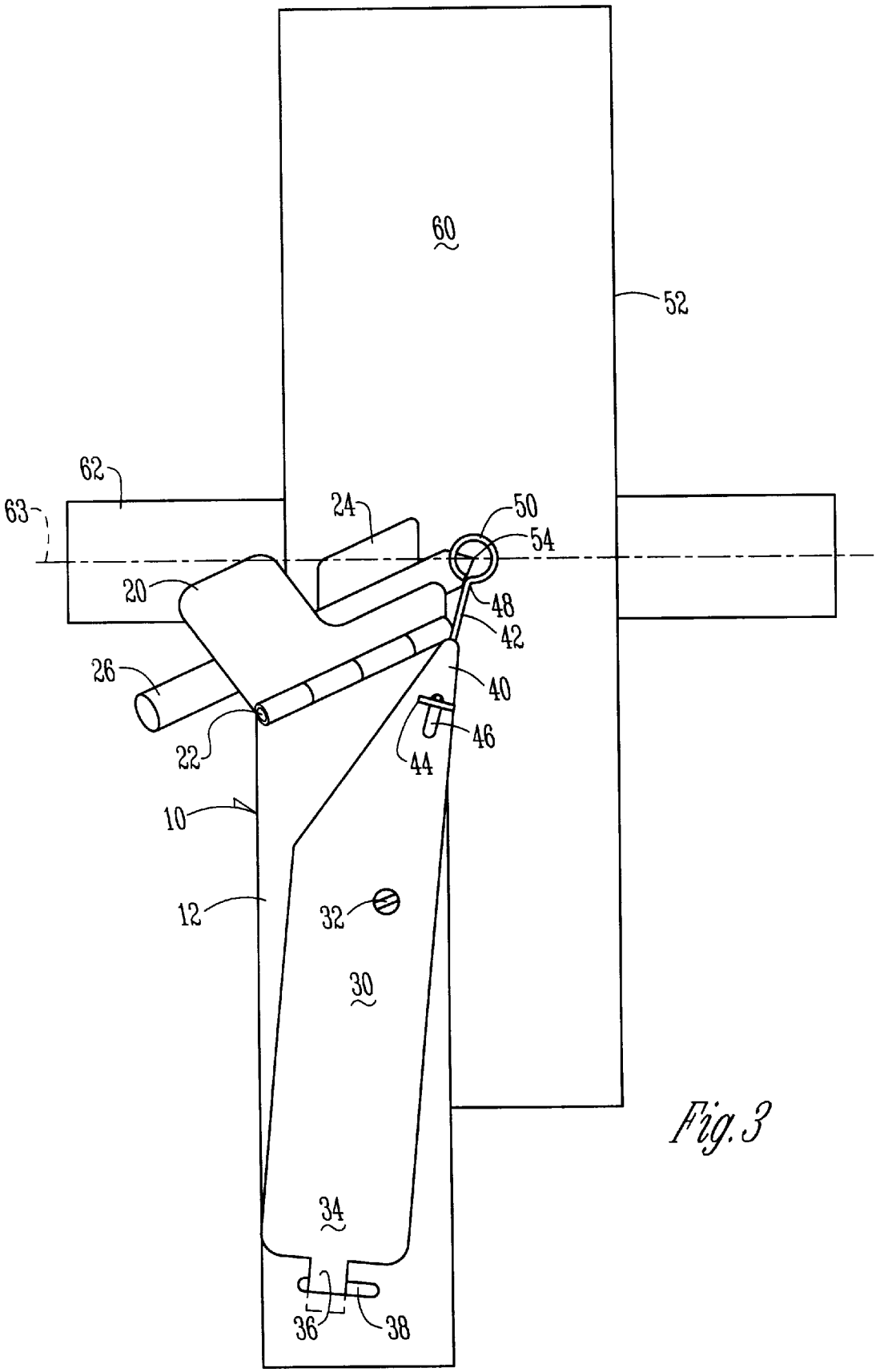
FIG. 3 is a view taken along lines 3—3 of FIG. 2.
Figure 4:
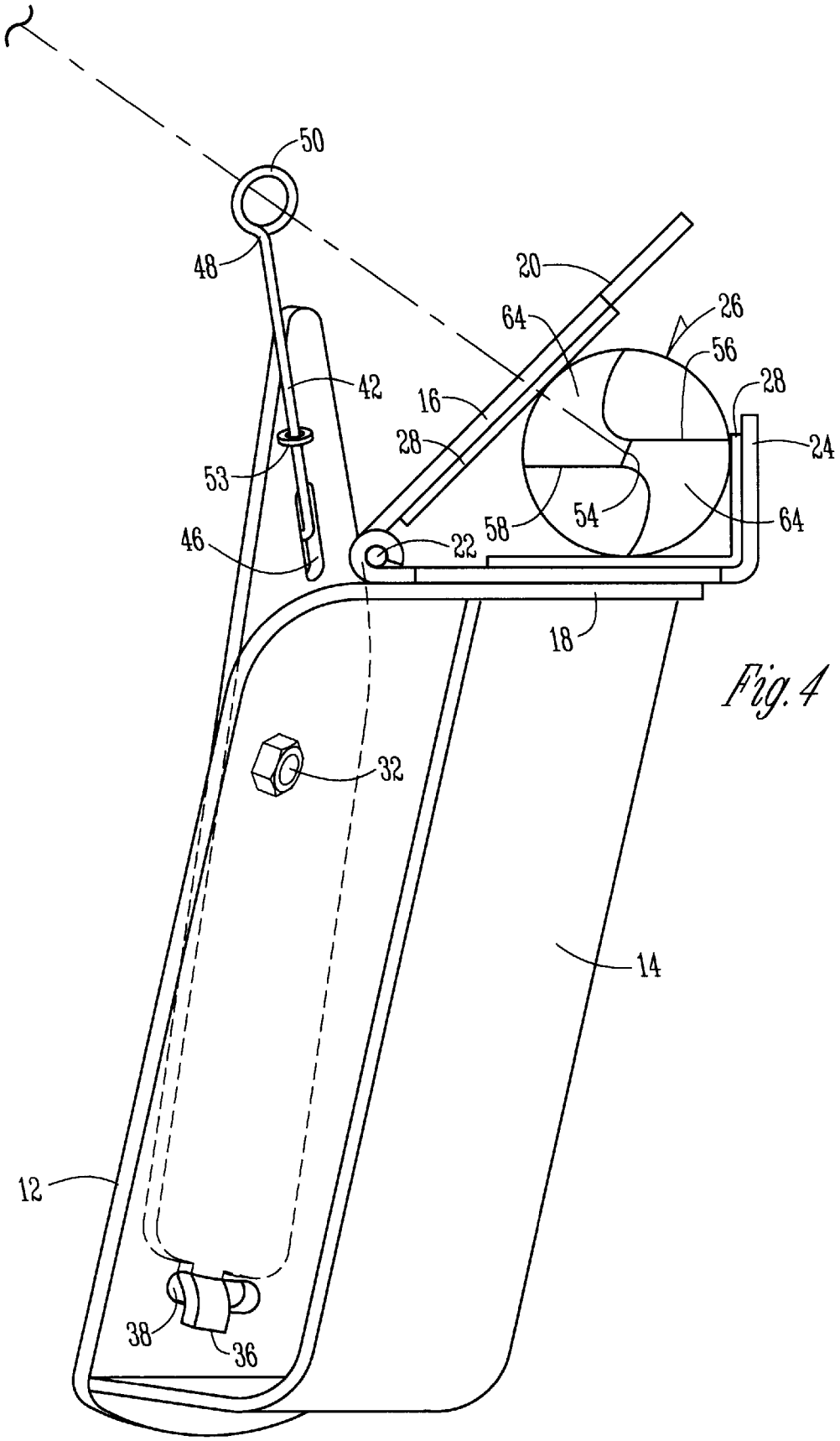
FIG. 4 is an end elevation view showing the tool with a large diameter drill bit positioned therein.
Figure 5:
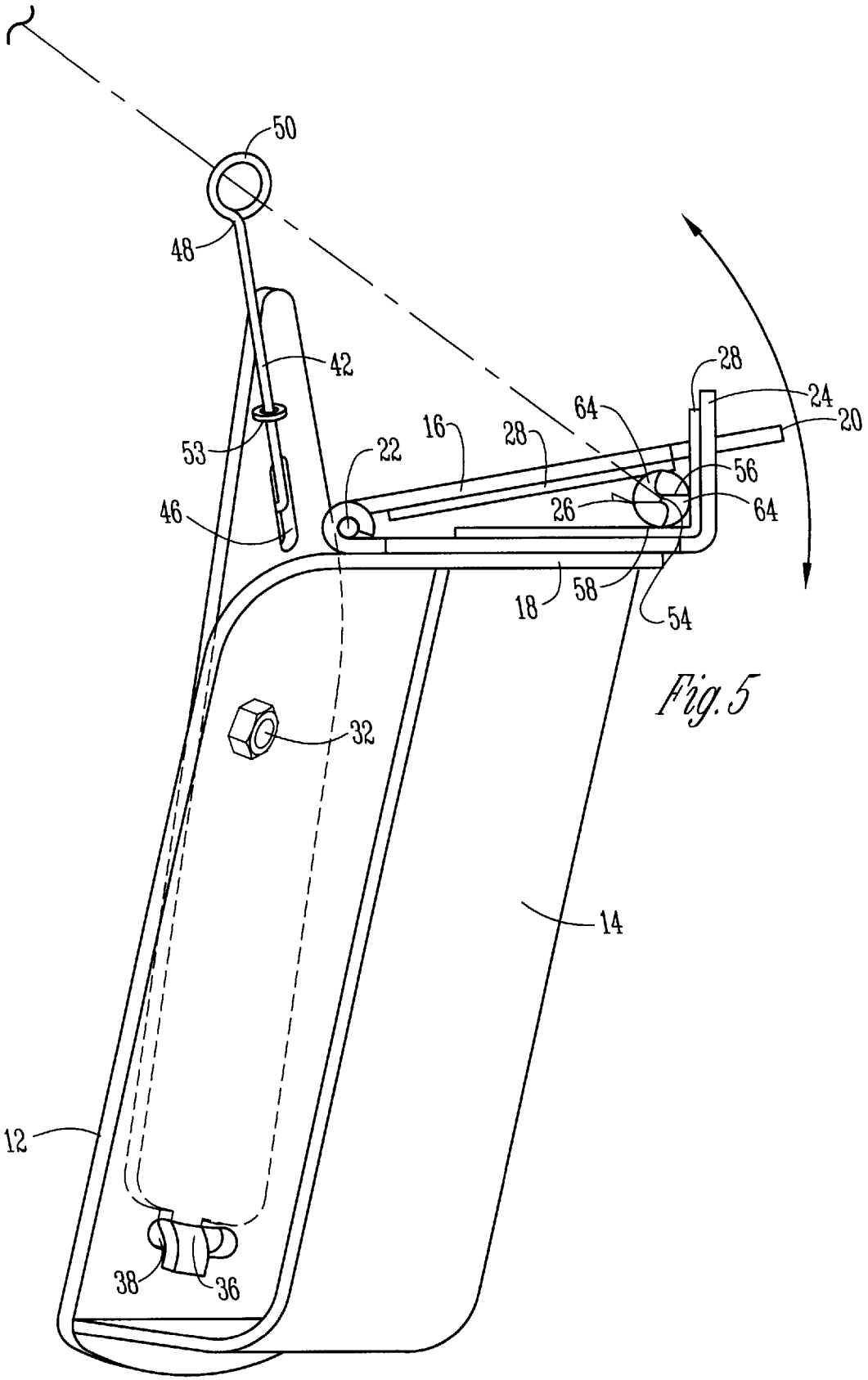
FIG. 5 is a view similar to FIG. 4 showing a small diameter drill bit positioned in the tool.

A clamp 16 is secured to the hand grip 12. As shown in the drawings, the clamp 16 is in the form of a hinge, with a fixed plate or leaf 18 and a pivotal plate or leaf 20, and a hinge pin 22. The edge 21 of the upper plate 20 extends beyond the edge 19 of the lower plate 18 to provide easy opening of the clamp 16. As best seen in FIG. 3, the longitudinal axis of the clamp 16 is disposed at an angle relative to the longitudinal axis of the hand grip 12. This angled orientation of the clamp 16 relative to the hand grip 12 facilitates proper positioning of the angled tip of the drill bit relative to the grinding wheel, as described below. The fixed plate 18 of the clamp 16 includes a leg 24 extending upwardly. The clamp 16 thus engages the drill bit 26 at three locations, as best seen in FIG. 4. A layer of material 28 may be glued, sprayed or otherwise provided on the plates 18 and 20 to keep the bit 26 from rotating when positioned in the clamp 16. The material 28 preferably has a coefficient of friction greater than that of the plates 18, 20. As a further alternative, the plates 18, 20 may be provided with serrations or teeth to facilitate the clamping of the bit 26 therebetween.

Figure 2:
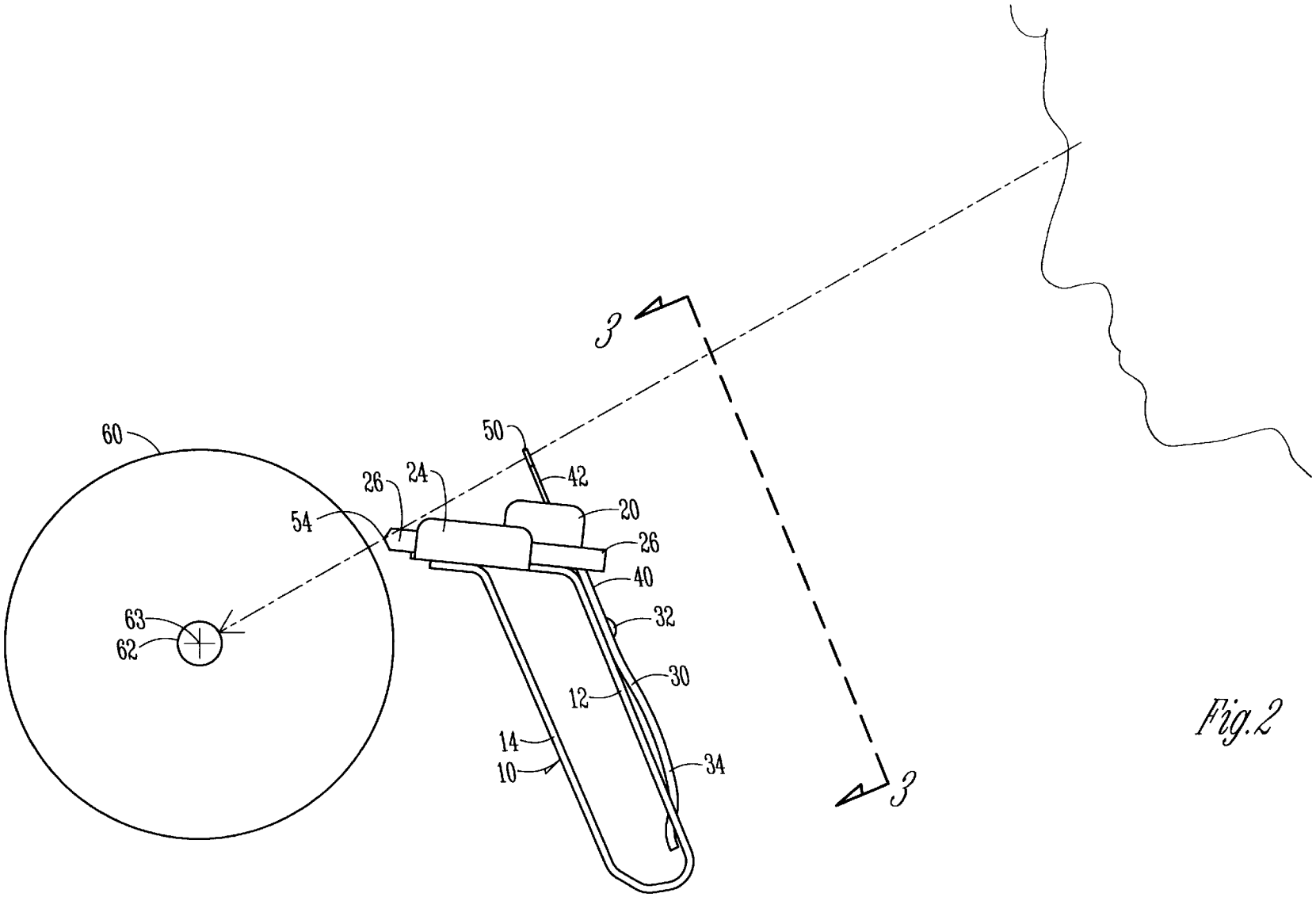
FIG. 2 is a schematic view showing the visual alignment of the drill bit tip using the tool of the present invention.

The tool 10 also includes a sight assembly for visually aligning the drill bit 26 for proper sharpening. More particularly, the sight assembly includes a bar 30 pivotally connected to the hand grip 12 by a fastener 32. The fastener 32 may be a nut and bolt, a rivet, or a screw. The lower end 34 of the bar 30 includes a leg 36 extending through a slot 38 in the hand grip 12. Preferrably, the bar 30 is slightly bowed or concave between its ends so as to provide a tensioned interference fit on the hand grip grip 12, as best seen in FIG. 2. Thus, upon loosening the fastener 32, the bar 30 is pivotal about the axis of the fastener 32, with the pivotal movement being limited by the extension of the leg 36 through the slot 38. This pivotal adjustablility of the sight bar 30 accommodates drill bits having tips with various cutting angles. Typically, the cutting angles are either 118° or 135°.

The upper end 40 of the sight bar 30 has an adjustable sight 42 mounted thereon. The sight 42 includes a lower end 44 extending through a slot 46 in the upper end 40 of the sight bar 30 for retention therein. The upper end 48 of the sight 42 terminates in a loop 50 to facilitate visual alignment of the tip of the drill bit 26 on the grinding wheel 52. The sight bar 30 includes a collar or guide 53 through which the sight 42 extends. Thus, the sight 42 is longitudinally adjustable within the slot 46 of the sight bar 30. The longitudinal adjustment of the sight 42 along the slot 46 permits the tool 10 to accommodate different diameter bits 26 and different distances of projection of the bit tip 54 beyond the end of the clamp 16. For example, for larger diameter drill bits, the sight 42 is extended upwardly, and for smaller bits, the sight 42 is slid downwardly, relative to the sight bar 30.

In using the tool 10, the drill bit 26 is inserted between the plates 18, 20 such that the tip 54 of the bit 26 extends a short distance beyond the clamp 16. The first and second cutting edges 56, 58 of the bit 26 are oriented parallel to the plate 18, as best seen in FIG. 4. The user applies thumb pressure to the pivotal plate 20 to retain the bit 26 in the clamp 16. The user holds the tool 10 with one or both hands, in a manner similar to aiming a pistol, and sights through the loop 50 of the sight 42 and the tip of the drill bit 26.

With the drill bit 26 held in the clamp 16, the tool 10 permits proper positioning of the bit tip 54 on the grinding surface 60 of the grinding wheel 52 so as to achieve proper sharpening of each cutting edge 56, 58.

Figure 6B:
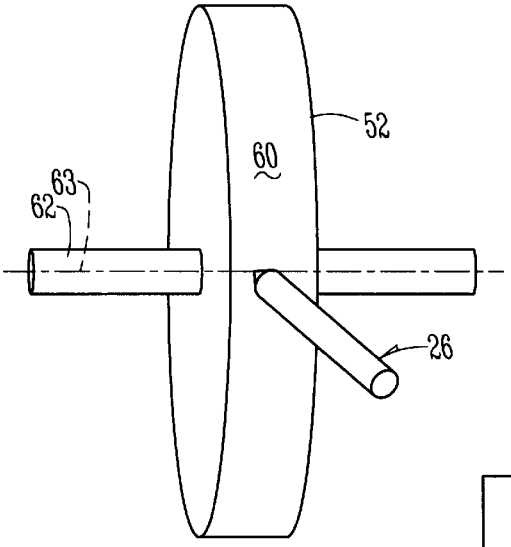
FIGS. 6A–6E are schematic views of the visual orientation of the drill bit relative to the grinding surface of the grinding wheel, with FIG. 6A showing proper visual alignment and FIGS. 6B–6E showing improper visual alignment.
Figure 6D:
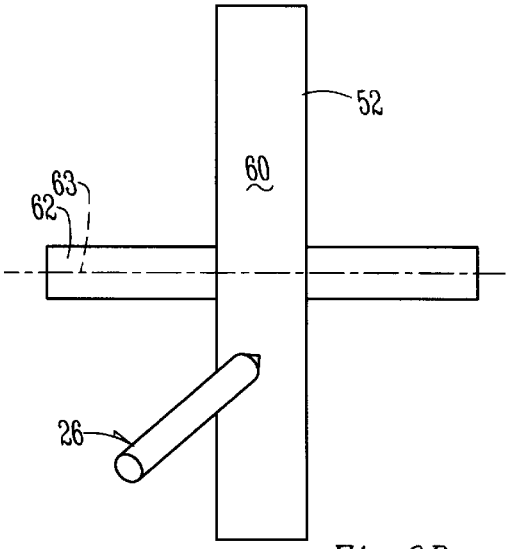
Figure 6A:
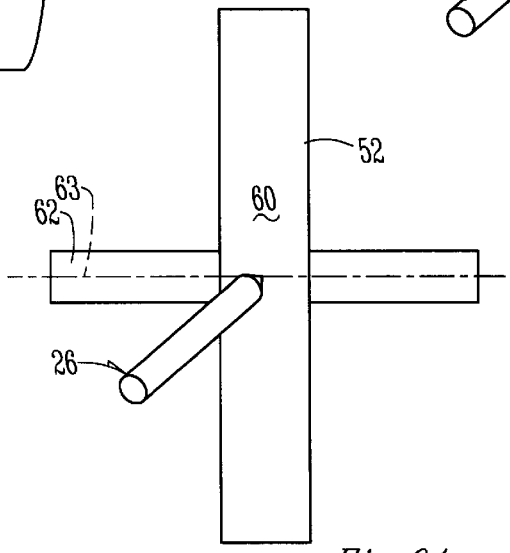
Figure 6C:
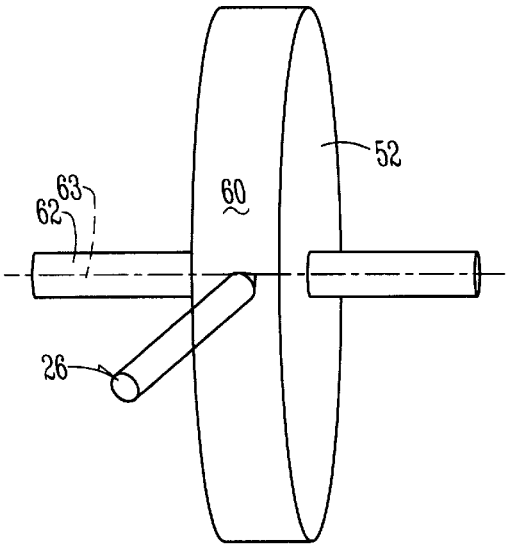
Figure 6E:
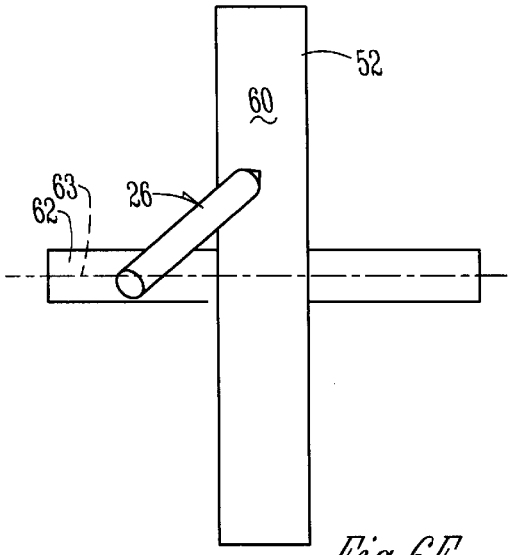

With the drill bit 26 positioned in the clamp 16, the user holds the tool 10 similar to a pistol so as to sight through the loop 50 of the sight 42 in alignment with the tip 54 of the bit 26 and the axis 63 of the axle 62 of the grinding wheel 52. As shown in FIG. 6A, the user should be viewing the grinding wheel 52 squarely in a plane perpendicular to the grinding surface 60. The user's visual alignment should not be to the left or to the right of the grinding wheel 52, as shown in FIGS. 6B and 6C. Similarly, the user's visual alignment should not be below or above the grinding wheel axle 62, as shown in FIGS. 6D and 6E.

Also, the tool 10 should be held such that the bit 26 is oriented at an angle relative to the grinding surface 60, with the angle corresponding to the cutting angle or slope of the bit tip 54, as best seen in FIG. 3. When the cutting edge 56 is sharpened, the hand grip 12 can be tilted slightly downward so as to round the heel 64 of the bit tip 26. After the cutting edge 56 is sharpened, the drill bit 26 can be rotated 180° in the clamp 16 such that the cutting edge 58 can be sharpened.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A hand-held drill bit sharpener device, comprising:

a grip portion adapted to be held in a user's hand;

a clamp on the grip portion adapted to hold a drill bit with a tip to be sharpened; and a sight attached and extending substantially from the grip portion to provide a sight line through the sight and the tip of the bit to visually align the tip of the bit for sharpening.

2. The device of claim 1 wherein the clamp is tightened with thumb pressure from the user.

3. The device of claim 1 wherein the clamp includes a hinge having leaves between which a bit is receivable.

4. The device of claim 1 wherein the sight is adjustable.

5. The device of claim 1 further comprising a guard for protecting the user's hand.

6. The hand-held drill bit sharpening device of claim 1 wherein the sight is loop shaped.

7. The hand-held drill bit sharpener device of claim 1, wherein the clamp includes a pair of plates, at least one of which is pivotal relative to the other, the bit being retained in the clamp by hand pressure on the clamp during grinding.

8. A tool for holding a drill bit for sharpening on a grinding wheel, the bit having a tip with opposing cutting edges, the device comprising:

a hand grip;

a clamp on the hand grip for holding the bit with the tip extending beyond the clamp; and a sight attached and extending substantially from the hand grip and defining a first sight point, the bit tip defining a second sight point, the first and second sight points defining a sight line to facilitate positioning of the bit tip on the grinding wheel for sharpening.

9. The tool of claim 8 wherein the sight is retractable and extendible.

10. The tool of claim 8 wherein the sight is laterally adjustable.

11. The tool of claim 8 wherein the clamp includes a pair of plates movable between an open position for receiving the bit and a closed position for holding the bit.

12. The tool of claim 11 wherein one of the plates is pivotally connected to the other plate.

13. The tool of claim 8 further comprising a guard on the hand grip to extend around the user's hand for protection from the grinding wheel.

14. The tool for holding a drill bit for sharpening on a grinding wheel of claim 6 wherein the sight is loop shaped.

15. A method of sharpening a cutting edge of a drill bit tip, comprising:

holding the bit in a hand-held tool, with the cutting edge of the bit extending beyond the tool;

visually aligning through a sight attached and extending substantially from the grip portion of the tool and the tip of the bit to orient the bit for sharpening; and engaging the cutting edge with the grinding wheel to sharpen the bit.

16. The method of claim 15 further comprising orienting the cutting edge horizontally during sharpening.

17. The method of claim 15 wherein the tip of the bit has a slope, the method further comprising orienting the bit at an angle relative to the grinding wheel, the angle being substantially the same as the slope of the bit tip.

18. The method of claim 15 wherein the visual alignment is perpendicular to the grinding wheel.

19. The method of claim 15 wherein the alignment is also through an axle of the grinding wheel.

* * * * *